US006322328B1

(12) United States Patent
Techet et al.

(10) Patent No.: US 6,322,328 B1
(45) Date of Patent: Nov. 27, 2001

(54) RADIAL PISTON PUMP

(75) Inventors: Gernot Techet, Augsburg; Klaus Stolle, Schwabniederhofen, both of (DE)

(73) Assignee: Hoerbiger Hydraulik GmbH, Schongau (DE)

( * ) Notice: Subject to any disclaimer, the term of this patent is extended or adjusted under 35 U.S.C. 154(b) by 0 days.

(21) Appl. No.: 09/604,014

(22) Filed: Jun. 26, 2000

(30) Foreign Application Priority Data

Jun. 25, 1999 (AU) ..... 1115/99

(51) Int. Cl.[7] ..... F04B 1/04; F04B 39/10
(52) U.S. Cl. ..... 417/273; 417/569; 417/570
(58) Field of Search ..... 417/273, 570, 417/569

(56) References Cited

U.S. PATENT DOCUMENTS 5,358,383 * 10/1994 Eisenbacher et al. ..... 417/569
5,634,777 * 6/1997 Albertin et al. ..... 417/273
6,168,393 * 1/2001 Huber et al. ..... 417/360
6,176,692 * 1/2001 Reinartz et al. ..... 417/454

* cited by examiner

*Primary Examiner*—Timothy S. Thorpe
*Assistant Examiner*—Michael K. Gray
(74) *Attorney, Agent, or Firm*—Dykema Gossett PLLC

(57) ABSTRACT

In a radial piston pump (2), which has pump elements (10) arranged radial in the pump housing (7) and which in turn have an inlet valve (11) and an outlet valve (12) activated by the medium, the valves (11, 12) are disposed at the outer side of the pump elements (10) whereby the inlet valves (11) are arranged coaxial relative to the pump piston (13). All inlet valves (11) are connected to a joint intake channel (20) that leads around the outside of the pump housing (7). To achieve a simple, flexible and operationally dependable design with a high degree of efficiency and low noise emission, the pump elements (10) are inserted from the outside and held in place in a bore (16) of the pump housing (7) as a complete unit, consisting of a cylinder barrel (15), a pump piston (13) and an inlet valve (11), and the joint inlet channel (20) is designed as a groove (21) that is open to the outside, which is covered with a fitted sealing member (22) after mounting of the pump element (10) onto the pump housing (7), and whereby said channel (20) is connected with the tank (4) via at least one bore (23) in the pump housing (7).

4 Claims, 2 Drawing Sheets

RADIAL PISTON PUMP

BACKGROUND OF THE INVENTION

1. Field of the Invention

The invention relates to a radial piston pump having a plurality of pump elements in a pump housing arranged substantially radially around an eccentric shaft whereby the pump elements have an inlet valve and an outlet valve activated by the medium that is to be pumped, and whereby the inlet valves and outlet valves are each disposed at the outer side of the pump elements that faces away from the eccentric shaft and whereby the inlet valves are each arranged, in their flow-through direction, in a continuous extension of the cylinder bore of the pump element substantially coaxial relative to the pump piston, and whereby all inlet valves are connected to a joint intake channel that leads around the outside of the pump housing.

2. The Prior Art

Radial piston pumps in the simplest construction, as they have been used for some time in small electric-powered hydraulic units for actuation of vehicle tops or the like, independent from the driving motor, are operated without valve control, which keeps structural requirements at a minimum but which allows only a low degree of efficiency. In addition to the unfavorable pressure conditions in each individual pump element, which is caused by control adjustments of each individual pump element, there is noise created in the entire interconnected hydraulic system as a result of pressure pulses, which is undesirable and disturbing.

For example, radial piston pumps have been made known in DE 197 26 572 A1, DE 197 25 563 A1 or also DE 197 25 564 A1 wherein an automatic check valve is provided on the inlet and outlet-side of each pump element, which increases the degree of (operational) efficiency of these pumps as they are used as high-pressure fuel pumps in so-called common-rail injection systems of combustion engines and which in turn lowers the operating noise. However, a disadvantage in these known arrangements are the large dead spaces or (cylinder) clearance caused by the arrangement of the valves as well as the relative complicated structural design, which increases costs in manufacturing, assembly and maintenance and which also increases breakdowns.

Furthermore, from WO 99/19621 there has been made known a radial piston pump of the type mentioned above, for example, wherein the inlet valves and the outlet valves are arranged respectively on the outer side of the pump element and whereby the inlet is arranged in its flow-through direction substantially coaxial relative to the pump piston, and the outlet valve is arranged in its flow-through direction substantially parallel and off-set relative to the eccentric shaft. In contrast to the above-mentioned known arrangements in which the inlet valve is arranged on the inner side of the pump elements facing the driving eccentric shaft and the outlet valve is arranged at the outer opposed side of the pump elements facing away—whereby over the entire length of the pump elements a dead space is created that influences the degree of efficiency negatively, which is caused by the always present residual elasticity of the medium to be pumped the two valves, which are necessary for the functioning of the pump, are now disposed on the same outer side of the pump element, which in turn makes possible a decrease of this dead space and thus an increase in the degree of efficiency.

A disadvantage of this known arrangement, which is designed for high-pressure fuel supply, especially in the above-mentioned common-rail injection systems with operational pressures of 1,000 bars or more, is mainly the necessary requirement to deal with these high pressures in view of dependable tightness, special construction or arrangement of valves, threaded joints, seals etc. For the hydraulic use mentioned in the beginning, particularly in the area of actuation of the vehicle tops or the like, at which operational pressures of the hydraulic medium in the range of approximately 20–40 bars are quiet sufficient, other criteria are in the foreground—specifically one should mention here the simple and cost-effective design, easy assembly and maintenance and the like.

Pump elements designed as complete units are generally known from DE 197 32 748, for example, but they are not intended for radial piston pumps with their necessary characteristic features. In addition, these pumps elements are not designed as more operationally dependable units and units that are easy to be dismantled since they are pressed into the cylinder bore of the pump housing and may only be removed by damaging the same. Finally, there are no indications in DE 197 32 748 to insert pump elements into bores that are interconnected by a surrounding joint inlet channel.

Such a joint inlet channel is in deed known from EP 304 750 A1, but it is not designed as a groove surrounding the pump housing and it is designed whereby its covering is not an attached sealing member that is separate from other housing components and whereby it is not assembled independently relative to the assembly of the actual pump housing.

It is the object of the present invention to improve a radial piston pump of the type stated above in such a manner that the mentioned disadvantages of the known arrangement of this type are avoided and that particularly a more simplified, flexible and operationally dependable design is made possible with a high degree of efficiency and low noise emission.

SUMMARY OF THE INVENTION

This object is achieved according to the present invention with a radial piston pump of the type mentioned above in that the pump elements are inserted from the outside and held in place in a bore of the pump housing as a complete unit, consisting of a cylinder barrel, a pump piston and an inlet valve, and whereby a joint inlet channel is designed as a groove that is open to the outside, which is covered with a fitted sealing member after mounting of the pump element onto the pump housing, and whereby said channel is connected with the tank via at least one bore in the pump housing. The pump elements may thereby be inserted as a complete unit from the outside into a corresponding bore of the pump housing in an easy fashion relative to assembly and maintenance. Similar constructions are known from WO 99/23387, EP 0 913 578 A or WO 99/25978 whereby, however, there are partly very different valve arrangements or problems with supply from the inlet-side of several mutually driven pump elements, which may not occur or which are at least not addressed therein. By the here suggested arrangement, according to the invention, there are highly advantageous possibilities to connect outside on the pump housing the radial bores, which receive the pump elements within the pump housing, via a groove that is open toward the outside—whereby there is obtained, in the simplest way, a connection of the inlet-side of all pump elements with the tank. This results in very simple assembly and maintenance-friendly construction, which has also a low flow-resistance based on the simple configuration of supply and discharge lines. Since the joint inlet channel is practically without pressure, its manufacturing and sealing in the described manner is completely uncritical and it may be realized through a separate component that is especially designed for sealing and which is fitted optimally to the respective conditions. The outlet line, which is under operational pressure, is disposed within the pump housing and may be sealed in the traditional manner.

According to a preferred embodiment of the invention, at least the inlet valves (and also the outlet valves, if needed) are designed as check valve cartridges that are inserted in the corresponding receiving bores, which very much simplifies the manufacturing, assembly and maintenance.

According to another embodiment of the invention, the pump pistons may be held in the pre-assembled pump elements by means of springs that are held in place and braced against the cylinder of the pump element and which pistons may be pushed against an eccentric mounted on the eccentric shaft in the assembled condition of the radial piston pump. On one hand, there is ensured thereby the mechanical cohesion and installation of pre-assembled pump element units and, on the other hand, operation without (excessive) play is made possible.

According to another especially preferred embodiment of the invention, it is proposed that the eccentric shaft and the eccentric are balanced by means of counterweights wherein this pre-assembled driving unit is inserted into a central bore of the pump housing from the side of the driving motor. This balancing may be performed in a known manner with one or more balancing weights, which thereby drastically reduces the otherwise occurring (strong) vibrations in the pump and which may also have a negative and disturbing effect on the entire hydraulic system in the already described manner. The complete pre-assembled driving unit may then be installed very simple in the pump housing, after which only the driving motor has to be coupled thereto.

The invention will be described in more detail below with reference to the partly schematically illustrated embodiment examples in the accompanying drawings.

DETAILED DESCRIPTION OF THE PREFERRED EMBODIMENT

Figure 1:
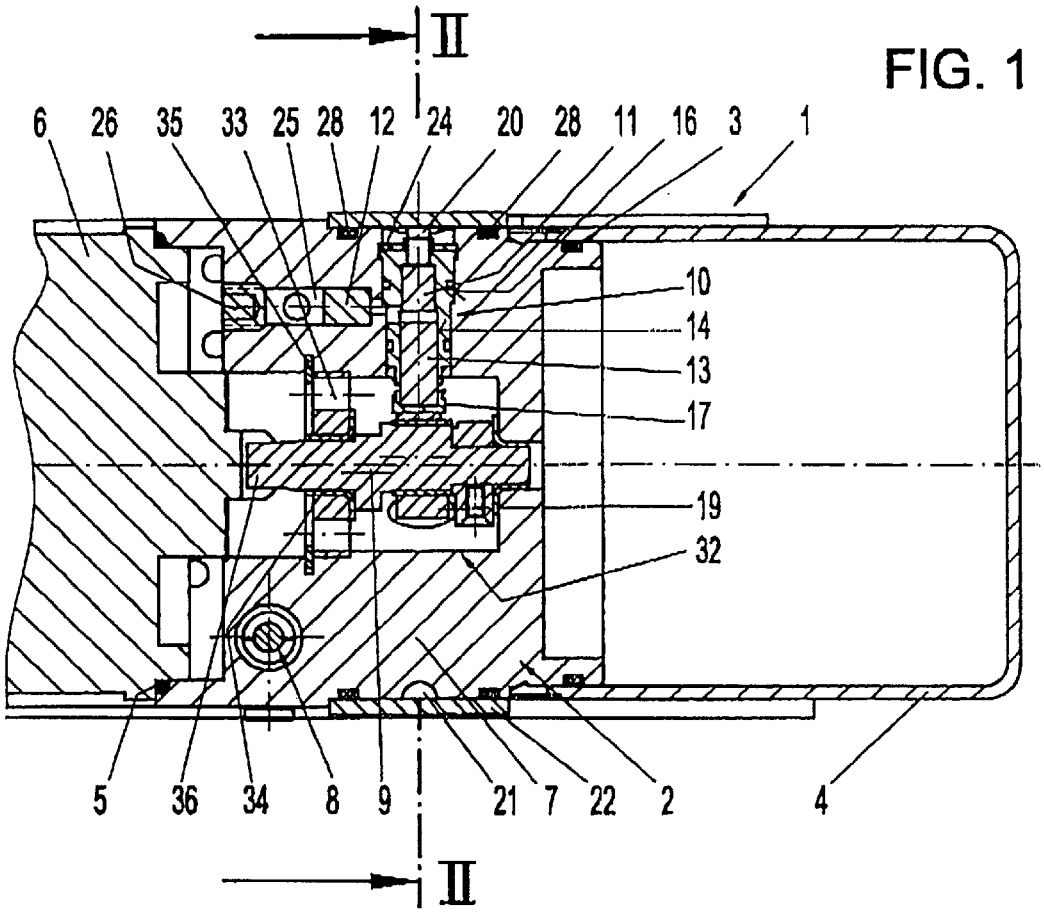
FIG. 1 shows a partial longitudinal sectional view through a radial piston pump installed into a small hydraulic unit.
Figure 2:
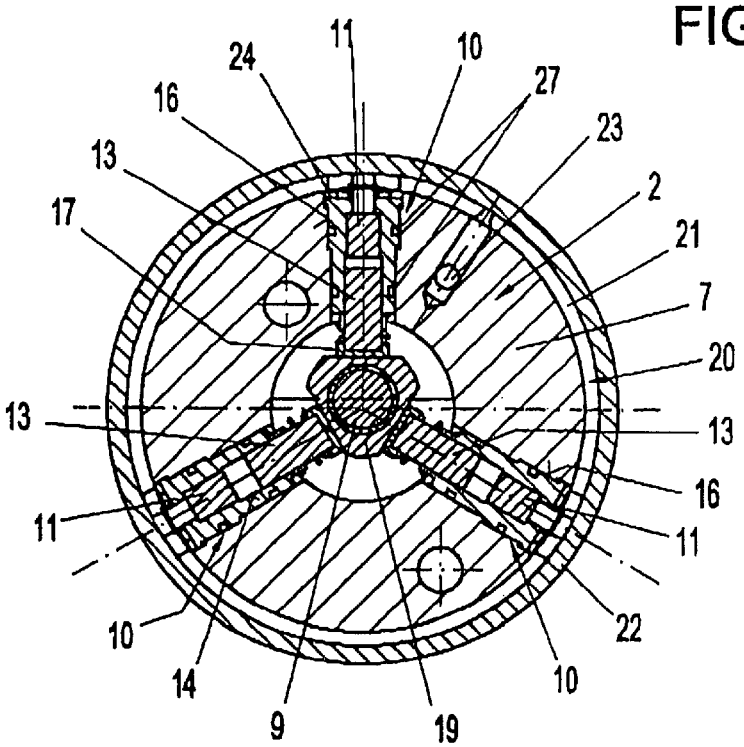
FIG. 2 shows a partial sectional view along the line II—II in FIG. 1.

As on can see especially in FIG. 1, the radial piston pump 2 is designed here as part of a small hydraulic unit 1, which is provided with a cup-shaped tank 4 that is disposed adjacent to the pump 2 and on the right side in the illustration in FIG. 1, and which is fitted thereto and sealed by means of a sealing ring 3, and which is also provided with a flange-mounted driving motor 6 at the opposed left side. The sealing ring that seals the interior space on this side is identified with the number 5. The pump housing 7 is here also designed to receive at least one part of the control element (control valves, pressure relief valves, check valves and the like), which are necessary for the use in a small unit of this type for the actuation of an automobile convertible top, for example, whereby only one of these control elements can be seen in FIG. 1 and it is identified with the number 8. Not illustrated are here the hydraulic connection lines to the operating units (actuation cylinder . . . ) as well as electric connection lines to the driving motor 6 or the fastening parts for the complete small unit.

The radial piston pump 2 itself is provided here with three pump elements in the pump housing arranged radial around an eccentric shaft 9 whereby said pump elements have each an inlet valve 11 and an outlet valve 12 activated by the medium that is to be pumped, and which valves are arranged together on the outer side of the pump elements 10 that faces away from the eccentric shaft 9. The inlet valves 11 are thereby arranged in their flow-through direction coaxial to the pump piston and the outlet valves are arranged in their flow-through direction off-set and parallel to the eccentric shaft 9, whereby only a very small dead space is created in the pump elements. The inlet valves 11 are each arranged in a continuous extension of the cylinder bore 14 of the pump elements (see FIG. 3) and said valves are designed as check-valve cartridges that are fitted into the corresponding receiving bores. The design of check-valve cartridges (with a spring-loaded ball against an annular seat, for example) are well known and therefore not further illustrated here.

Figure 3:
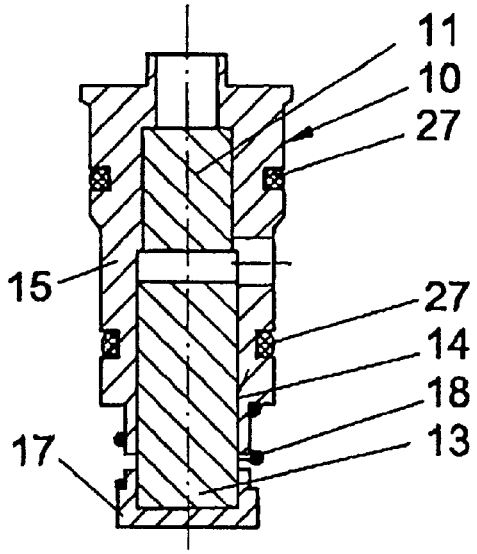
FIG. 3 shows a longitudinal sectional view in an enlarged scale through a pre-assembled pump element of the radial piston pump according to FIG. 1 and FIG. 2.

In the arrangement illustrated in FIG. 3, the pump elements 10 are inserted from the outside into a bore of the pump housing 7 as complete units consisting of cylinder barrel 15, pump piston 13 and inlet valve 11. The pump pistons 13 are held in the preassembled pump element 10 by a fitted sliding disk 17 and a spring 18, which is held in place by radial pre-tensioning and by being braced against the sliding disk 17 as well as against the underside of the cylinder barrel 15 (see particularly FIG. 15) and the pump pistons 13 are pushed against an eccentric 19 that is mounted with bearings on the eccentric shaft 7 in the assembled condition of the radial piston pump, whereby the eccentric 19 transfers the lift movement of the eccentric shaft onto the pump piston and whereby now a lateral sliding motion between the sliding disk 17 and the corresponding surface of the eccentric 19 is created.

All inlet valves 11 on the outer side of the pump elements 10 are connected within the pump housing 7 by a common joint inlet channel 20, which is designed as a groove 21 that is open toward the outside and which leads around the outside of the pump housing connecting the bores 16, which receive the pump elements 10. The groove 21 is covered by a mounted annular sealing member 22 after assembly of the pump elements 10 and the groove 21 is connected with the interior area of the tank 4 by at least one bore 23 in the pump housing 7. Before mounting of the annular sealing member 22, the inserted pump elements 10 are simply held in place in the bores 16 by means of a retaining ring 24.

The outlet valves 12 are arranged immediately adjacent to the proposed outlet lines of the pump elements 10 in the pump housing 7. As one can see in FIG. 1, said outlet valves 12 may be inserted from the left side into the corresponding bore of the outlet line 25, while the driving motor 6 has not been mounted yet, whereby the bore may then be sealed from the outside by means of a sealing plug 26. The continuation of the outlet line 25 to the above-mentioned control of the unit is not shown.

The pump pistons 13 are designed with considerable overlap relative to the cylinder bore 14 in the cylinder barrel

15 whereby the tolerances between cylinder bore and the outside of the piston may be increased keeping the same high degree of efficiency, which in turn allows a simpler and thereby a more cost-effective production or also allows the use of softer materials, for example, which furthermore allows savings in expenditures. The outlet-side of the pump elements 10 is sealed above and below the outlet line 26 by means of proposed sealing rings 27. According to FIG. 1, sealing rings 28 are fitted to the pump housing at the inlet-side, specifically to the left and right of the surrounding groove 21, whereby they seal off the area with pressure from the tank together with the seal 22.

Figure 4:
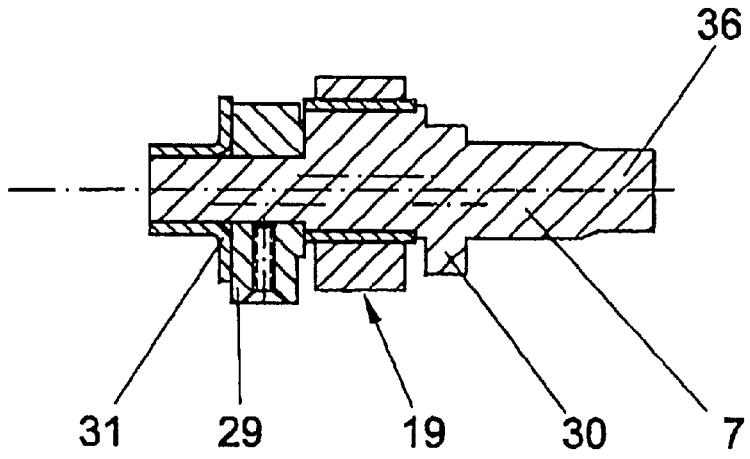
FIG. 4 shows a longitudinal sectional view in and enlarged scale through a pre-assembled driving unit of the radial piston pump according to FIG. 1 and FIG. 2.
Figure 5:
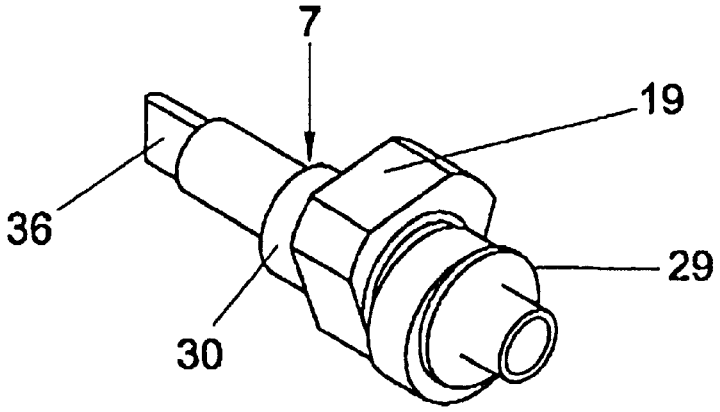
FIG. 5 shows a perspective view of the driving unit according to FIG. 4.

According to FIG. 4 and FIG. 5, the eccentric shaft 9 and the eccentric 19 are balanced by means of counterweights 29, 30 whereby the counterweight 29 may be removed here to make upward sliding of the eccentric 19 possible, whereas the counterweight 30 and the eccentric shaft 7 are made in one piece. The pre-assembled unit consisting of eccentric shaft 9, eccentric 19, counterweight 29 and bearing 31 (see FIG. 4) may be inserted from the side of the driving motor 6 during assembly of the pump in a central bore 32 of the pump housing 7 while said driving motor has not been installed yet. Subsequently, there are inserted the support member 33 and the bearing 34, which are located to the left of the eccentric 19 in FIG. 1, and which are then held in place in the bore 32 by a retaining ring 35. The pump elements 10 may be later installed into the bore 16 from the outside, as previously described, and also be held in place by means of retaining rings 24. The assembly on the right side, according to FIG. 1, is completed after sliding on the seal 22 and the tank 4. After sliding in the outlet valves 12, and after installing the sealing plug 26, only the driving motor 6 has to be pushed in and fastened whereby the motor engages the drive stud 36 of the eccentric shaft 9 with a corresponding recess in the drive shaft—after which the very simple assembly of the radial piston pump has been completed.

What is claimed is:

1. A radial piston pump (2) having a plurality of pump elements (10) in a pump housing (7) arranged substantially radially around an eccentric shaft (9) whereby said pump elements have an inlet valve (11) and an outlet valve (12) activated by the medium that is to be pumped, and whereby the inlet valves (11) and outlet valves (12) are each disposed at the outer side of the pump elements (10) that faces away from the eccentric shaft (9) and whereby said inlet valves (11) are each arranged, in their flow-through direction, in a continuous extension of the cylinder bore (14) of the pump element (10) substantially coaxial relative to the pump piston (13), and whereby all the inlet valves (11) are connected to a joint intake channel (20) that leads around the outside of the pump housing; characterized in that the pump elements (10) are inserted from the outside and are held in place in a bore (16) of the pump housing (7) as a complete unit, consisting of a cylinder barrel (15), a pump piston (13) and an inlet valve (11), and whereby a joint inlet channel (20) is designed as a groove (21) that is open to the outside, which is covered with a fitted sealing member (22) after mounting of the pump elements (10) onto the pump housing (7), and whereby said channel (20) is connected with a tank (4) via at least one bore (23) in the pump housing (7).

2. A radial piston pump housing according to claim 1, wherein at least the inlet valves (11) are designed as check-valve cartridges that are inserted in the respective receiving bores.

3. A radial piston pump according to claim 1, wherein the pump pistons (13) are held in the pre-assembled pump elements (10) by means of springs (18), which are held in place and braced against the cylinder barrels (15) of the pump elements (10), and whereby said pump pistons (13) are pushed against an eccentric (19) mounted on the eccentric shaft (9) in the assembled condition of said radial piston pump (2).

4. A radial piston pump according to claim 1, wherein the eccentric shaft (9) and the eccentric (19) are balanced by means of counterweights (29, 30) and wherein this pre-assembled driving unit is inserted in a central bore (32) of the pump housing (7) from the side of the driving motor (6).

* * * * *